US005924306A

United States Patent [19]

Sinelnikov

[11] Patent Number: 5,924,306

[45] Date of Patent: Jul. 20, 1999

[54] METHOD FOR DEMETHANIZING GAS MIXTURES

[76] Inventor: David Pavlovich Sinelnikov, 47, korpus 1, kv.25, ulitsa Molodogvardeiskaya, Russian Federation

[21] Appl. No.: 08/981,275

[22] PCT Filed: Jul. 3, 1995

[86] PCT No.: PCT/RU95/00143

§ 371 Date: Dec. 24, 1997

§ 102(e) Date: Dec. 24, 1997

[51] Int. Cl.[6] ..... F25J 1/00

[52] U.S. Cl. ..... 62/623; 62/626; 62/909

[58] Field of Search ..... 62/623, 626, 909

[56] References Cited

U.S. PATENT DOCUMENTS

| | | | |
|---|---|---|---|
| 3,119,677 | 1/1964 | Moon et al. . | |
| 4,225,329 | 9/1980 | Bailey et al. | 62/623 |
| 4,987,744 | 1/1991 | Hanoley | 62/623 |
| 5,566,555 | 10/1996 | Hewitt | 62/617 |

FOREIGN PATENT DOCUMENTS

| | | |
|---|---|---|
| 25 02 959 | 7/1976 | Germany . |
| 410223 | 5/1974 | U.S.S.R. . |
| 1208169 | 10/1970 | United Kingdom . |

*Primary Examiner*—Ronald Capossela

*Attorney, Agent, or Firm*—Gary M. Nath; Nath & Associates

[57] ABSTRACT

A method for gas mixture demethanization is suitable for decreasing the loss of the target product (ethylene) and power requirements for gas mixture demethanization process. The gas mixture demethanization method consists in the progressive cooling of the initial gas mixture via the external and internal cycles with the formation of the intermediate partial condensates of the mixture components, rectification of these condensates with the production of a demethanized liquid phase and a gaseous methane fraction, cooling the latter via the external cycle with the formation of a partial condensate, separation and utilization of this condensate as the coolant for the said cycle by throttling the condensate, its evaporation with the mixture under cooling and recirculation into the initial gas mixture, the methane phase, before being cooled via the external cycle and prior to being separated, being additionally cooled via the internal cycle along with its use for cooling the initial gas mixture, the internal cycle coolant being supercooled prior to throttling by its participation in the heat-exchange process with the intermediate partial condensate of the initial gas mixture, generated as a result of its cooling via the internal cycle. Moreover, along with the additional cooling of the methane fraction, the stripped vapors from the lower section of the rectification tower are also cooled prior to their being fed to its upper section.

3 Claims, 2 Drawing Sheets

METHOD FOR DEMETHANIZING GAS MIXTURES

FIELD OF INVENTION

The present invention relates to the separation of hydrocarbon and, more particularly, ethylene-containing gases, using a low-temperature rectification technique and can be used in the petrochemical, oil-processing, and gas industries, largely in the production of ethylene.

PRIOR ART

A method has been proposed (see U.S. Pat. No. 3,119,677, Int. Cl. 62-23, 1964 [1]) consisting in the deep cooling of a mixture, prior to its separation, down to temperatures from minus 120 to minus 130° C., the process being exercised in a stepwise manner with the intermediate condensates brought out to a demethanizer. It should be noted that cooling to temperatures between minus 90 and minus 95° C. is effected through an external cascade-type cycle on propylene and ethylene used as the coolants. Then, the mixture is cooled via an "internal" cycle using a partial condensate as follows. Part of the condensate that is formed as the gas mixture is cooled to minus 100° C. or so, is throttled (as this takes place, its temperature decreases), evaporated by taking the heat off the gas mixture that, accordingly, becomes less heated, and recycled to the initial gas mixture. At a hydrogen/methane ratio of 1:2 by volume (gasoline pyrolysis gases) this condensate comprises a methane-ethylene mixture containing as much as 90% of methane, so that the above-mentioned "internal" cooling cycle ensures the gas mixture being cooled in the range between minus 120 and minus 130° C. Used as the condensate in the demethanization process [1] is a fraction obtained upon cooling the vapors tapped after the rectification step with the ethylene (the coolant).

The method [1] is disadvantageous in that it is characterized by low efficiency when applied to gas mixtures in which hydrogen is a major component. Thus, for the ethane pyrolysis gases (a hydrogen/methane ratio of 4:1) the hydrocarbon condensate resulting from cooling this mixture to temperatures between minus 120 and minus 130° C. contains as much as 65 vol. % ethylene and ethane, so that when evaporating such a condensate, the bulk of the cold can be generated at temperatures above minus 100° C. with the result that the said method [1] suitable for the demethanization of ethane pyrolysis gasses affords their cooling prior to being rectified to temperatures between ca. minus 100° C. to minus 105° C. only. The result is a higher loss of the target product, namely, ethylene, because of a decreased amount of the condensate involved in the rectification process and higher ethylene losses with the residual gas.

Another gas mixture demethanization method (see the USSR Author' Certificate No. 410223 Int. Cl. F 25JI] 00, 1974 [2]) is more advantageous in this respect. It consists in a stepwise cooling of the gas mixture under pressure via the internal and external cycles with the formation of intermediate partial gas mixture components and their rectification with the production of a liquid demethanized phase and a gaseous methane fraction. As this takes place, the internal cooling cycle is obtained by throttling the coolant in the form of the partial condensate produced from the above methane fraction that is cooled via the external cycle and recycling the said throttled condensate, after it has been used as the coolant, to the initial gas mixture.

Method [2] is more efficient than method [1] when dealing with the gas mixtures in which hydrogen is a relatively abundant component, e.g., such as products resulting from ethane pyrolysis. This occurs due to lower gas mixture cooling temperatures prior to rectification, as compared to those in method [1], because the internal cooling cycle depends on the use of a partial condensate (the coolant) containing methane, a low-boiling component, whose proportion is greater in method [2] than in method [1] (70 vol. % and 35 vol. %, respectively).

However, the efficiency of demethanization method [2] is also restricted, since it also entails a high loss of the target product, i. e., ethylene, escaping with the gas phase which is detained after the partial condensate (the internal cycle coolant) has been obtained from the methane fraction, and, moreover, is characterized by a limited specific refrigeration capacity of the internal cooling cycle, which fact generates a need for additional power for the gas mixture demethanization purpose. These demerits of method [2] are attributed to a low methane fraction cooling depth in the production of the partial condensate (the internal cycle coolant). This leads to the low-boiling components such as ethylene and methane being insufficiently condensed with the result that the concentration of ethylene in the residual gas is higher than normal (10 to 18 vol. %), whereas that of methane in the partial condensate (the coolant) is not high enough, which entails an additional loss of the target product (ethylene) and a limited refrigeration capacity of the internal cooling cycle, respectively.

Furthermore, one more drawback of method [2] consisting in the low specific refrigeration capacity of the internal cooling cycle is generated by a low temperature of its coolant prior to throttling, as this leads to considerable throttling losses.

As far as the combination of features is concerned, method [2] is the closest to the present invention and as such is taken as the prototype.

DISCLOSURE OF THE INVENTION

The present invention is aimed at finding solutions to cutting the loss of the target product and power consumption in the gas mixture demethanization process. To do so, the following performance results, in respect with prototype [2], are attained:

(1) Decreasing the concentration of the target product (ethylene) in the residual gas as the partial condensate (an internal cycle coolant) is being produced from the methane fraction resulting from the rectification of the intermediate condensates of the initial gas mixture (e.g., ethane pyrolysis gases).

(2) Increasing the content of the low-boiling mixture component (methane) in the said partial condensate (the coolant).

(3) Cutting the throttling losses of this component.

The above performance advantages result from the fact that, as compared to the known method [2] consisting in the progressive stepwise cooling of the compressed gas mixture via the internal cycle and regenerative heat exchange with the back flows to give rise to a gas-liquid mixture, interstage separation of the latter into gas and liquid phases, tapping the gas flow product after the terminal stage, its separation with the back flows to effect the regenerative heat exchange with the initial gas mixture, feeding the thus separated liquid flows to the rectifier with the production of a demethanized liquid phase product and a gaseous methane fraction, cooling the latter via the internal cycle with a partial formation of a condensate, its separation into gaseous and liquid phases, and tapping the back flows of the liquid and gaseous methane fractions following the separation stage to effect the regenerative heat exchange with the initial gas mixture, the following operations are to be carried out:

Prior to being separated, the methane fraction is additionally cooled in the regenerative heat exchange process with the gaseous fraction that has been withdrawn following the separation step, the liquid methane fraction flow is divided into two parts, one of which is throttled with temperature decrease and fed back to effect evaporation with the heat input from the additionally cooled methane fraction, after evaporation the second methane fraction flow is fed to be mixed with the first flow component after its regenerative heat exchange with the initial gas mixture prior to its being separated at the terminal stage, the methane fraction, before it has been mixed and involved in the stepwise regenerative heat exchange process, is allowed to recycle, with compression, to the initial gas mixture and, besides, before being throttled, the first liquid methane phase flow is supercooled in the regenerative heat exchange process with the liquid flow coming to the rectification stage following the terminal initial gas mixture separation stage, and the stripped vapors from the lower rectification tower, before being fed to the upper section of the tower and along with the additional cooling of the methane fraction, are being cooled, too.

BRIEF DESCRIPTION OF THE DRAWINGS

FIGS. [1] and [2] show a schematic diagram of an arrangement for the gas mixture demethanizer according to the present invention.

On this diagram the positions stand for the following components:

| | |
|---|---|
| 1, 3, 5, 7, 10, 13, 27 | - Recuperative heat-exchangers |
| 2, 4, 6, 8, 11, 23, 24, 26 | - Evaporative coolers |
| 9, 12, 17, 31 | - Separators |
| 14, 16 | - Tube space of heat-exchanger 13 |
| 15, 29 | - Expansion valves |
| 18 | - Rectification tower |
| 20 | - Blind plate |
| 21 | - Hydraulic lock |
| 22 | - Overflow line |
| 25 | - Boiler |
| 28, 30 | - Tube space of heat-exchanger 27 |

THE PREFERRED EMBODIMENT OF THE PRESENT INVENTION

The performance characteristics indicated in the "Disclosure of the Present Invention" Section above are attained as follows.

Figure 1:
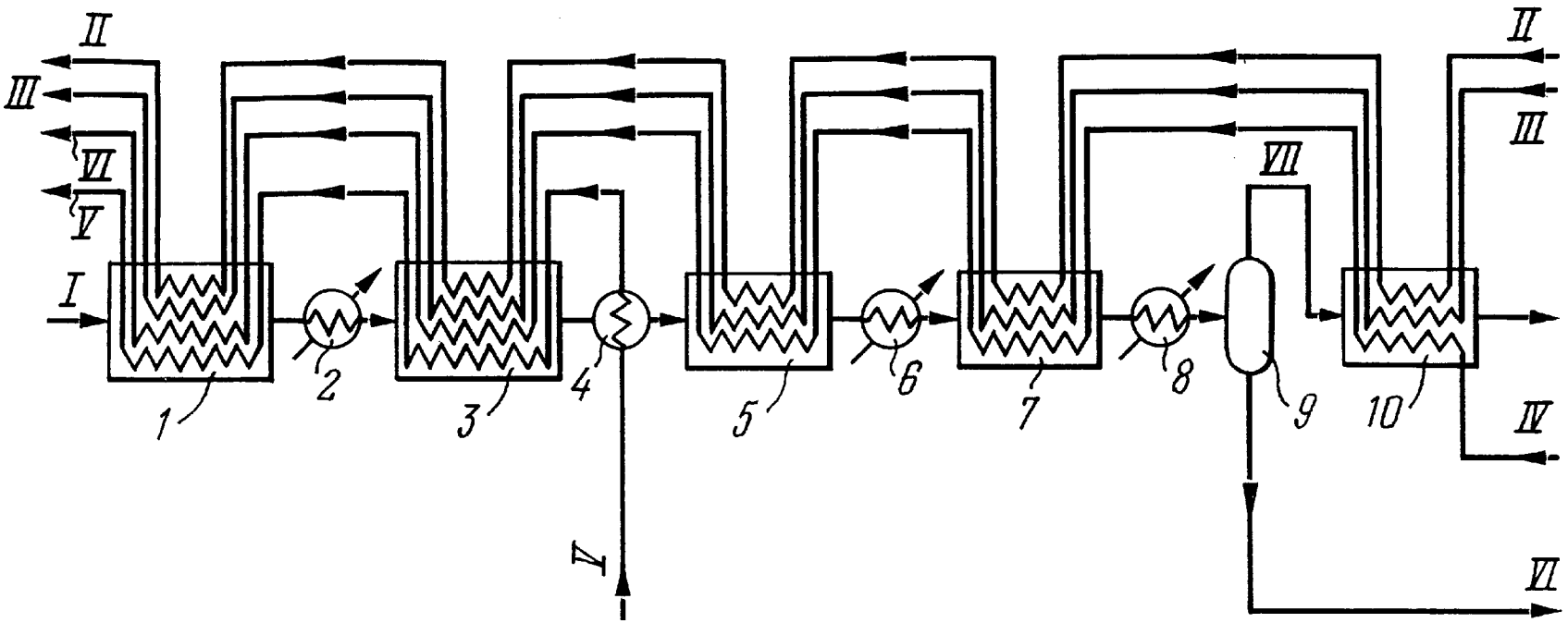
Figure 2:
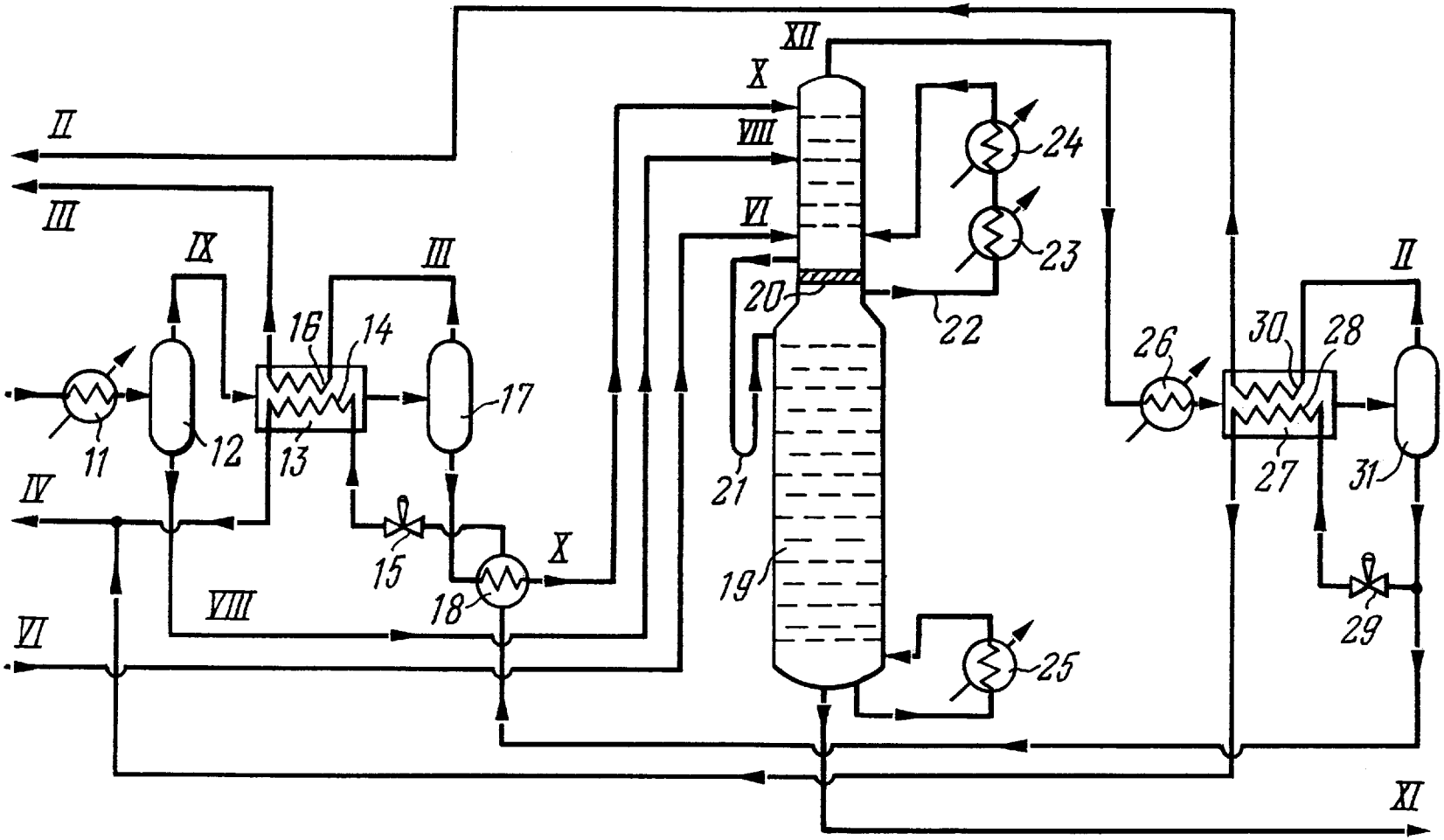

The initial gas mixture comprising the hydrocarbon raw material pyrolysis gases, e.g., ethane, compressed to 37–38 ata and dried is sequentially passed (flow I on the diagram of the arrangement in FIG. 1) through the recuperative heat-exchangers 1, 3, 5, 7 and evaporative coolers 2, 4, 6, 8, in which the said mixture is cooled to a temperature of minus 65° C. or so. As this takes place, the said step in these recuperative heat-exchangers is exercised using product flows II, III, a circulation flux IV of the arrangement, and evaporated ethane flow V, and in the evaporative coolers with external (relative to the arrangement) cooling cycles, namely, in position 2: propylene (this agent being used as the coolant), and in positions 6 and 8 with ethylene (at two boiling temperatures). Moreover, in position 4 the gas mixture is cooled due to the boiling of the liquid ethane product (flow V). The initial gas mixture thus cooled to a temperature of minus 65° C. or so undergoes a partial condensation. In a separator 9 the intermediate partial condensate is isolated and is fed (flow VI) to the rectification stage. The remaining gas phase (flow VII) is then further cooled in a regenerative heat exchanger 10 where it draws cold from the products II and III and also a circulation flow IV of the arrangement and then to the evaporative cooler 11 (see FIG. 2) in which it is cooled via the external cycle (the ethylene-type at a still lower, than in positions 6 and 8, boiling point of about minus 98° C.). The gas mixture thus cooled to a temperature of minus 95° C. or so undergoes a partial condensation. In a separator 12 the resulting intermediate partial condensate is isolated and is fed to the rectification stage (flow VIII). The remaining gas phase (flow IX) is then further cooled in a heat-exchanger 13 via the internal cycle's coolant boiling in a tube space 14 of the heat-exchanger 13 after being throttled in an expansion valve 15 and with the product flow III of the arrangement, circulating in a tube space 16 of this heat-exchanger. The gas mixture thus cooled by virtue of heat removal to a temperature of minus 130° C. or so undergoes a partial condensation. In a separator 17 the resulting intermediate partial condensate is isolated and, following its heating with the internal cycle coolant in a heat-exchanger 18, is fed (flow X) to a rectification tower 19. Note that the gas phase at the inlet of the separator 17 comprises the product flow III of the arrangement (a hydrogen fraction) which enters the said tube space 16 of the heat-exchanger 13.

A blind plate 20 divides the rectification tower 19 into two sections, namely, upper and lower, with mass-exchange being exercised between them through a hydraulic lock 21 and the vapor exchange through an overflow line 22 which includes evaporative coolers 23 and 24 for the external coolant cycle to take place there (at two boiling points) ensuring the cooling of the stripped vapors from the lower part of the tower 19, coming to the upper section of the tower, to a temperature of minus 65° C. or so. The intermediate partial condensate coming in flows VI, VIII, and IX to the corresponding zones of the upper section of the tower 19 undergoes fractionation in this tower at a pressure of 34 ata or so. The stripped vapors are generated in the lower section of the tower 19 through a process by which the low-boiling components of the liquid built up in the bottom section of the tower are evaporated with the aid of a heater 25. As far as the demethanized liquid containing components $C_2$ and higher is concerned, it is brought out of the arrangement as the product (flow XI). The stripped vapors are first fixed in the lower part of the tower 19 due to the heat-exchange process with the liquid coming through the hydraulic lock 21 and are lastly fixed in the upper section of the tower 19 as a result of both their being cooled in the evaporative coolers 23 and 24, this process leading to the formation of a partial condensate of the high-boiling components, and heat exchange with the intermediate partial condensate (flows VIII and X) entering the tower 19, whose temperature is lower than that of the said vapors. The thus fixed vapors comprising a methane fraction are brought out through a section above the tower 19 (flow XII).

Then, the methane fraction is progressively cooled in an evaporative cooler 26 to a temperature of minus 95° C. or so via an external cycle and in a heat-exchanger 27 where the heat is abstracted therefrom with a coolant operating in this cycle, boiling in the tube space 28 of the heat-exchanger 27 after being throttled in an expansion valve 29 and with the product flow II of the arrangement, circulating in the tube space of this heat-exchanger. The methane fraction, having being cooled to a temperature of minus 115° C. or so by tapping the heat, undergoes a partial condensation. The resulting gas/liquid phase is divided in a separator 31. The gas flow leaving the separator 31 comprises the product flow II of the arrangement with an ethylene content of no more than 0.2 to 0.3 vol. %, which comes to the said tube space 30 of the heat-exchanger 27 in which the heat is additionally abstracted from the methane fraction and then is brought out of the arrangement with the regeneration of its cold with the aid of the initial gas mixture in the regenerative heat exchangers 10, 7, 5, 3, 1. Note that the methane fraction condensate leaving the separator 31 is used as the coolant of the said internal cycle, for which purpose this condensate (methane-ethylene) is directed for being simultaneously throttled down to a pressure of 2 to 3 ata in the said expansion valves 15 and 29. At this stage the condensed coolant is supercooled with the intermediate partial condensate in the heat-exchanger 18 before the expansion valve 15. As a result of this throttling operation, the temperature of the coolant decreases and then it is placed in the said tube spaces 14 and 28 of the heat-exchangers 13 and 27, respectively, as the source of cold, where they evaporate off and thereby produce a cooling job. Then, the two flows of the evaporated coolant mix together to give rise to a circulation flow IV which is brought out of the arrangement with the regeneration of its cold with the aid of the initial gas mixture in the recuperative heat-exchangers 10, 7, 5, 3, 1. After that, this coolant is allowed to recirculate through a compressor to the initial gas mixture, because it contains a fairly large amount of the target product, namely, ethylene.

COMMERCIAL APPLICABILITY

The present invention may find applications in the treatment of gases resulting from the light-weight hydrocarbon pyrolysis, as well as in the petrochemical, oil-processing, and gas industries.

I claim:

The claims defining the present invention are as follows:

1. A method suitable for gas mixture demethanization, including a progressive stepwise cooling of a compressed gas mixture via an external cycle and regenerative heat exchange with the aid of back flows with the formation of a gas-liquid mixture, an interstage separation of the latter into a gas and a liquid phase, withdrawal of the product flow at the end of the terminal separation stage using a back flow to effect a regenerative heat exchange with the initial gas mixture, feeding the thus separated liquid flows for rectification with the production of a demethanized liquid product phase and a gas methane fraction, cooling the latter via the external cycle with the partial formation of a condensate, its separation into a gas and liquid phase, and withdrawal of the methane fraction upon its separation with the back flows to effect a regenerative heat exchange with the initial gas mixture, this method being distinguished by that prior to being separated, the methane fraction is additionally cooled in the regenerative heat exchange cycle with the gaseous fraction withdrawn upon separation, the liquid methane fraction flow upon separator being divided into two components one of which is throttled with temperature decrease and in the form of a back flow fed to effect a regenerative heat exchange with the initial gas mixture prior to its terminal separation stage, the second component is throttled with temperature decrease and fed to effect evaporation with the heat being supplied from the additionally cooled methane fraction, upon evaporation the second methane fraction flow is fed for being mixed with the first flow after its regenerative heat exchange cycle with the initial gas mixture prior to its terminal separation stage, the methane fraction being fed for recirculation and compression to the initial gas mixture after its mixing and regenerative heat exchange in a stepwise manner.

2. The method of claim 1 above distinguished by that prior to being throttled, the first liquid methane fraction is supercooled in the regenerative heat-exchange cycle with the liquid flow coming for rectification after the terminal stage of the initial gas mixture separation.

3. The method of claim 1 above, distinguished by that along with the additional cooling of the methane fraction, the stripped vapors from the lower section of the rectification tower are also cooled prior to their being fed to its upper section.

* * * * *